United States Patent [19]

Sheng

[11] Patent Number: 4,989,871

[45] Date of Patent: Feb. 5, 1991

[54] BADMINGTON RACQUET STRUCTURE

[76] Inventor: Chang C. Sheng, 9-1, Lane 161, Hsing Hn Rd., Sec. 1, Taichung, Taiwan

[21] Appl. No.: 517,813

[22] Filed: May 2, 1990

[51] Int. Cl.[5] ..... A63B 49/02

[52] U.S. Cl. ..... 273/73 G; 273/73 J

[58] Field of Search ..... 273/73 R, 73 C, 73 G, 273/73 H, 73 J

[56] References Cited

U.S. PATENT DOCUMENTS

| | | | |
|---|---|---|---|
| 2,395,864 | 3/1946 | Gerlings | 273/73 J |
| 4,575,084 | 3/1986 | Yoneyama | 273/73 G |

FOREIGN PATENT DOCUMENTS

| | | | |
|---|---|---|---|
| 1209277 | 10/1970 | United Kingdom | 273/73 G |
| 1446306 | 8/1976 | United Kingdom | 273/73 G |
| 2026327 | 2/1980 | United Kingdom | 273/73 G |
| 2037168 | 7/1980 | United Kingdom | 273/73 G |

*Primary Examiner*—Edward M. Coven
*Assistant Examiner*—William E. Stoll

[57] ABSTRACT

The present invention relates to an improved racquet structure. More particularly, it relates to an improved badminton racquet structure of greater integrity and rigidity and that, moreover, can be manufactured with greater efficiency. The improved badminton racquet structure comprises a head frame with hitting net strung over it, a hollow T-shaped connector rigidly attached to the head frame on one side, a handle with a co-axial internal cavity, a connecting tube placed between and extending into the interval cavity and hollow of the T-shaped connector, and two rigid retaining elements positioned at the opposite ends of the connecting tube, which are seated in two retaining flares formed on the opposite ends of the connecting tube.

3 Claims, 2 Drawing Sheets

BADMINGTON RACQUET STRUCTURE

BACKGROUND OF THE PRESENT INVENTION

The present invention relates to a racquet structure and more particularly to an improved badminton racquet structure of greater integrity and rigidity.

In conventional badminton racquet structures, the coupling between the head frame and the handle, through a connecting tube, is usually a source of considerable inconvenience to the user as the union is usually of poor integrity due to conventional assembly methods. After prolonged usage the head frame and/or handle tend to come loose, begin to rotate about its axis, and eventually come apart completely. The latter in fact often occurs while the racquet is in heave use, i.e. when in play.

In the present invention, however, a much sturdier and rigid connection is formed between the head frame and handle through changes in the structure of the connecting tube. Moreover, the improved structure of the present invention lends to improved efficiencies in manufacturing.

The improved badminton racquet structure comprises a head frame with hitting net strung over it. a hollow T-shaped connector rigidly attached to the head frame on one side, a handle with a co-axial internal cavity, a connecting tube placed between and extending into the interal cavity and hollow of the T-shaped connector, and two rigid retaining elements positioned at the opposite ends of the connecting tube, which upon forced insertion of the connecting tube causes two retaining flares to be formed on the opposite ends of the connecting tube.

SUMMARY OF THE PRESENT INVENTION

The present invention relates to an improved racquet structure. More particularly, it relates to an improved badminton racquet structure of greater integrity and rigidity and that, moreover, can be manufactured with greater efficiency. The improved badminton racquet structure comprises a head frame with hitting net strung over it, a hollow T-shaped connector rigidly attached to the head frame on one side, a handle with a co-axial internal cavity, a connecting tube placed between and extending into the interval cavity and hollow of the T-shaped connector, and two rigid retaining elements positioned at the opposite ends of the connecting tube, which upon forced insertion of the connecting tube causes two retaining flares to be formed on the opposite ends of the connecting tube.

The two retaining flares press against the sides of the internal cavity of the handle, which may contain a sleeve, and also against the inner wall of the T-shaped connector on either end of the connecting tube. This results in considerable deformation and great frictional force, resulting in a rigid and long lasting coupling between the handle, head frame and T-shaped connector, and connecting tube.

Moreover, compared to conventional racquets that require the use of adhesives to secure the corresponding components together, this improved racquet structure, which can be assembled without the use of adhesives and their inevitable curing times, greatly facilitates automated assembly and higher productivity.

PREFERED EMBODIMENT OF THE PRESENT INVENTION

Figure 1:
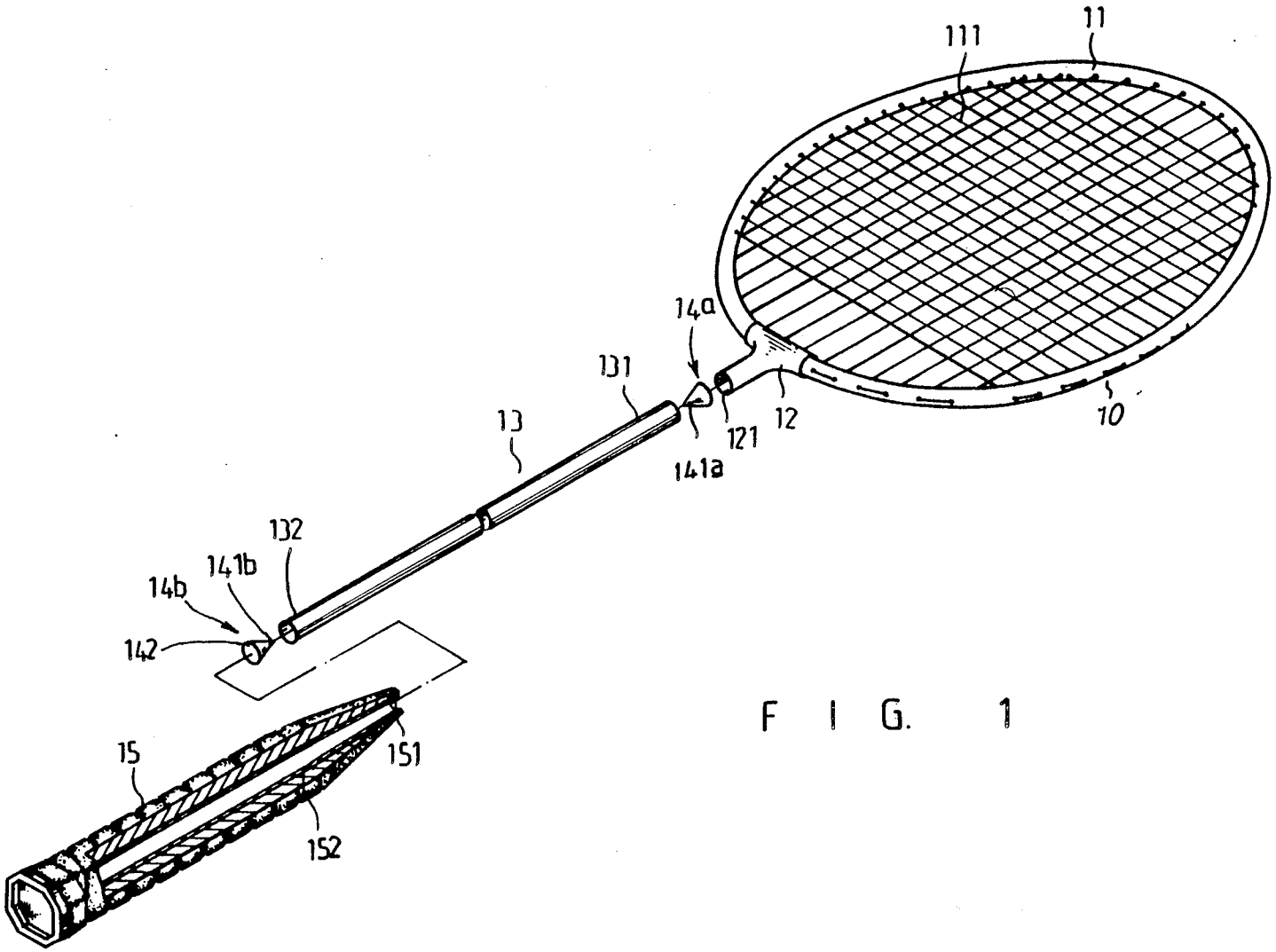
FIG. 1 is a perspective exploded view of the present invention.

Refering to FIG. 1, the improved badminton racquet structure 10 is comprised of hitting frame 11, T-shaped coupler 12, handle 15, connecting tube 13, and retainer cones 14*a* and 14*b*.

The frame 11 is of a substantially oval shape and is threaded through with strong fibers in a criss-crossing manner forming a net 111. On one side of the frame 11, along the longer axis of the oval, is positioned a hollow T-shaped coupler 12.

The handle 15 is elongated and of a substantially tube shape. A cylindrical receiving cavity 151 is formed in the center of the handle 15 and is co-axial with it. Firmly positioned against the inside wall of the receiving cavity 151, is an inner sleeve 152 which has an inner diameter substantially the same as the inner diameter of the connector inlet 121 of the T-shaped connector 12.

A hollow cylindrical connecting tube 13 has an outside diameter substantially the same as the inside diameters of the receiving cavity 151 of the handle 15 and the coupler inlet 121 of the T-shaped coupler 12. Upon assembly the front section 131 and rear section 132 of the connecting tube 13 are inserted axially into the connector inlet 121, of the T-shaped coupler 12, and the receiving cavity 151 of the handle 15, respectively.

The front retainer cone 14*a* and rear retainer cone 14*b*are rigid, cone shaped elements with apexes 141*a* and 141*b*, and bases 142*a* and 142*b*, respectively. The bases 142*a* and 142*b* of the front and rear retainer cones 14*a* and 14*b*, respectively, have outside diameters marginally smaller than the inside diameters of the connector inlet 121 or the inner sleeve 152.

Figure 2:
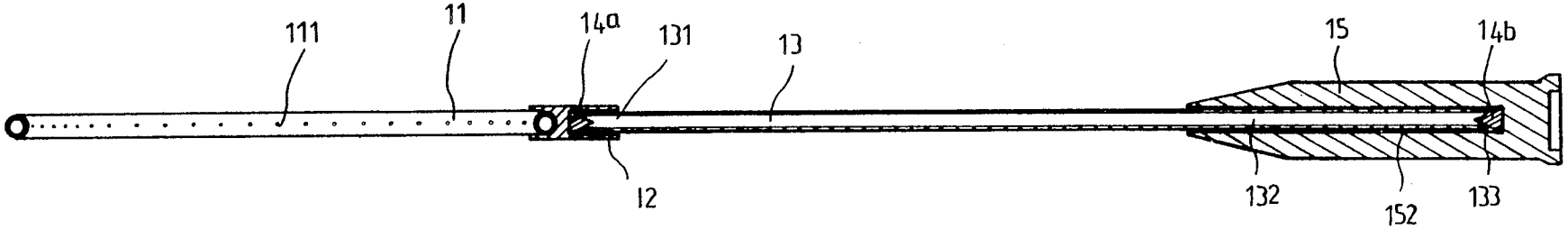
FIG. 2. is a cross-sectional view of the present invention.

Refering to FIG. 2, it can be seen that the rear retainer cone 14*b* is disposed at the rearmost section of the inner sleeve 152 with apex 141*a* pointing towards the front. The front retainer cone 14*a* is disposed at the frontmost position within the coupler inlet 121 with apex 141*b* pointing towards the rear. Thus the apexes 141*a* and 141*b* point towards each other and the axis of rear retainer cone 14*b* and front retainer cone 14*a* are aligned.

The rear section 132 of connecting tube 13 is forcibly inserted into the inner sleeve 152 of the handle 15 by a suitable source of compressive force such as a hydraulic unit. The rear end of the rear section 132 impinges against the sides of the rear retainer cone 14*b* and deforms under the force of insertion. The deformation causes the cylindrical end of the rear section 132 to expand divergently, forming rear retaining flare 133*b*. In a similar manner the front section 131 of connecting tube 13 is forcibly inserted into the coupler inlet 121 of the T-shaped coupler 12 positioned at the frontmost part of coupler inlet 121.

The retaining flares, 133*a* and 133*b*, exert a large force against the sides of the rear of the inner sleeve 152, and the sides of the frontmost part of the T-shaped coupler, respectively. This force along with the consequent deformation causes the connecting tube 13 to lock rigidly to the structure of the handle 15 and to the frame 11 through the T-shaped connector 12. The physical integrity thereby obtained is far better than in a conventional badminton racquet that relies on a pure friction fit or uses adhesives. Which often become loose or fall apart after extended usage.

I claim:

1. An improved badminton racquet structure comprising; a head frame of substantially oval shape, said head frame threaded through in a criss-crossing fashion forming a net surface within said head frame; a T-shaped connector disposed on one side of said head frame along its major axis, said T-shaped connector being hollow; a handle with an internal receiving cavity co-axial with said handle; a connecting tube disposed to a maximum extent, on either end of said connecting tube, within said receiving cavity and said T-shaped connector; said connecting tube being co-axial with said handle and major axis of said head frame; two rigid retaining elements, one each of said rigid retaining elements disposed at the rearmost space in said receiving cavity and at the frontmost space inside of said T-shaped connector, said retaining elements being co-axial with said receiving cavity and said T-shaped connector; and two outward retaining flares formed at the opposite ends of said connecting tube, forming a sturdy connection between said connecting tube and said handle and head frame.

2. An improved badminton racquet structure as in claim (1) with said rigid retaining elements of a substantially cone shape.

3. An improved badminton racquet structure as in claim (1) with said handle comprising said internal receiving cavity with an inner sleeve, said inner sleeve having an inside diameter substantially equal to the outside diameter of said connecting tube.

* * * * *